US006568830B2

(12) United States Patent
Yaphe et al.

(10) Patent No.: US 6,568,830 B2
(45) Date of Patent: May 27, 2003

(54) END CAP JOINT FOR LINEAR FIXTURES

(75) Inventors: Howard Yaphe, Ville St-Laurent (CA); Pascal Toupin, Cornwall (CA); Robert Katz, Montreal (CA); Sylvain Duchesne, Montreal (CA)

(73) Assignee: Canlyte Inc., Lachine (CA)

( * ) Notice: Subject to any disclaimer, the term of this patent is extended or adjusted under 35 U.S.C. 154(b) by 0 days.

(21) Appl. No.: 09/965,156

(22) Filed: Sep. 27, 2001

(65) Prior Publication Data

US 2002/0080606 A1 Jun. 27, 2002

(30) Foreign Application Priority Data

Sep. 28, 2000 (CA) ..... 2321342

(51) Int. Cl.[7] ..... F21S 4/00
(52) U.S. Cl. ..... 362/219; 362/238; 362/147; 362/225; 362/370
(58) Field of Search ..... 362/219, 238, 362/145, 146, 147, 223, 224, 225, 217, 370

(56) References Cited

U.S. PATENT DOCUMENTS 2,344,935 A * 3/1944 Whittaker ..... 362/219
4,866,583 A * 9/1989 Targetti ..... 362/404
4,933,820 A * 6/1990 Engel ..... 362/217
5,479,327 A * 12/1995 Chen ..... 362/222

OTHER PUBLICATIONS

Segretto, "Modular Lighting Unit", U.S. Pub. No. 2002/0118537, Aug. 29, 2002.*

* cited by examiner

*Primary Examiner*—Sandra O'Shea
*Assistant Examiner*—Sharon Payne
(74) *Attorney, Agent, or Firm*—Jeffrey A. Haeberlin; Middleton Reutlinger

(57) ABSTRACT

There is disclosed a linear fixture layout where one or more linear fixtures extending along different longitudinal axes are offset from each other by a predetermined angle. The fixtures each have end portions, which are positioned adjacent to and spaced from each other. The fixtures each have end caps mounted to the end portions of the linear fixtures and connected to each other by an interconnecting member so as to present a continuous fixture layout. The end caps have a slot in a side portion thereof and the interconnecting member has two legs spread apart from each other at the predetermined angle. Each of the legs is adapted to be mounted in sliding relation into a corresponding end cap slot to fixedly locate the end caps together and present continuous fixture layout appearance.

12 Claims, 19 Drawing Sheets

END CAP JOINT FOR LINEAR FIXTURES

FIELD OF THE INVENTION

The present invention relates to joining the end portions of linear fixtures, particularly lighting and other fixtures.

BACKGROUND OF THE INVENTION

Modular suspended linear fixtures are typically assembled in place by connecting and mounting individual modules. Typical linear fixtures are suspended from an overhead structure and include linear fluorescent lighting systems. Such lighting fixtures may radiate light upwardly against the ceiling or downwardly towards the work area. Imprecise inter-fitting of such modular lighting systems results in an unsightly and unprofessional appearance and spaces between the completed assembly through which light radiates when switched on.

Typically these assemblies are suspended at heights of 7 ft. or more from the floor. Mounted and joining prior art structures entail cumbersome and sometimes dangerous procedures. It is common to lay out the linear fixtures in adjacent parallel rows or with a row of the linear fixtures extending transversely across rows of fixtures to square off the pattern of lighting. Typically, the ends of fixtures laid out in a square pattern are spaced from each other providing a gap in the fixture appearance. Consequently, the appearance of the fixtures suspended from the overhead structure does not always provide a uniform aesthetic appearance. Further, by having these end portions spaced apart from each other, it is difficult to wire or hide wiring extending between the end portions of fixtures which do not abut one another.

SUMMARY OF THE INVENTION

The present invention relates to a linear fixture layout where one or more linear fixtures extending along different longitudinal axes have end portions which are positioned adjacent to each other and connected to each other through end caps fitted to the end portions of the linear fixtures. In particular, the present invention relates to having end caps that are mounted to the end portions of the linear fixtures and are adapted to be interconnected with each other to provide a continuum or continuous layout of the linear fixtures. The advantage with this continuous layout is that it allows linear fixtures to extend along different longitudinal axes that meet at end portions to provide an anesthetic joining of the end portions of the linear fixtures. Further, power and control wiring from one fixture can be passed to an adjacent fixture through the end caps.

In the present invention, it is envisaged that two end caps are adapted to be mounted to end portions of the respective linear fixture, which linear fixtures extend along two longitudinal axes offset by a predetermined angle. An interconnecting member for the end caps has two legs spread apart from each other at the predetermined angle. Each of the legs is adapted to be mounted to a corresponding end cap to fixedly locate the end caps together.

The predetermined angle may be any angle and, in practice, most likely is an angle of 90 degrees. However other angles such as 45, 60, 75, 105, 125, and 145 degrees may, for example, be suitable.

Preferably, the linear fixture layout of the first and second end portions of the first and second linear fixtures are positioned spaced apart from each other and the first second end caps abut each other.

The lighting fixtures preferably comprise an elongated housing having at least a first bottom wall and first joiner support mounted to the first bottom wall at the first end portion. The end caps are preferably mounted to the joiner support.

Preferably, the linear fixture comprises a hanger member adapted to respectively interconnect the first end cap with the first joiner support. The hanger member is preferably adapted for suspension by a wire from an overhead structure for supporting the linear fixture from the overhead structure.

The side of the end cap preferably has a slot for receiving in sliding relation one of the two legs of the interconnecting member. The leg preferably has a side surface that bridges the slot presenting a continuous surface side for the end cap. More preferably, the end caps each have opposing inner surface walls extending adjacent with and on opposing sides of the slot. Each of the legs includes two elongated flanges extending co-extensive with, spaced from, and on opposing sides of each of the side surfaces of the legs. The two flanges slide along the inner surface walls of the end cap to maintain the continuous surfaces in or across the slot.

Preferably, the end caps each have top and bottom walls having a cross-sectional shape of an eyelet with opposing sides of the end caps normally defined where the top wall and bottom wall meet. The side of the end cap has a first slot in its top wall for receiving in sliding relation one of the legs of the interconnecting member. Preferably, each of the legs has two arms in a generally U-shape with one arm extending along the slot and the other arm extending along a bottom wall inside surface.

In accordance with an aspect of the present invention there is provided a linear fixture layout comprising first and second linear fixtures each extending along respective first and second axis which are offset from each other by a predetermined angle. Each of the first and second linear fixtures has respective first and second end portions positioned adjacent from each other. The layout further comprises a first end cap, a second end cap and an interconnecting member. The first end cap is adapted to be mounted to a first end portion of the first linear fixture. The first end cap has a first side. The second end cap is adapted to be mounted to a second end portion of the second linear fixture and the second end cap has a second side. The interconnecting member has first and second legs spread apart from each other at the predetermined angle. The first leg is mounted to the first side and the second leg is mounted to the second side to fixedly locate the first end cap with the second end cap.

BRIEF DESCRIPTION OF THE DRAWINGS

The invention will be better understood and its advantages will become more apparent to those skilled in the art by reference to the following drawings, in conjunction with the accompanying specification, in which.

DETAILED DESCRIPTION OF PREFERRED EMBODIMENTS

Figure 1:
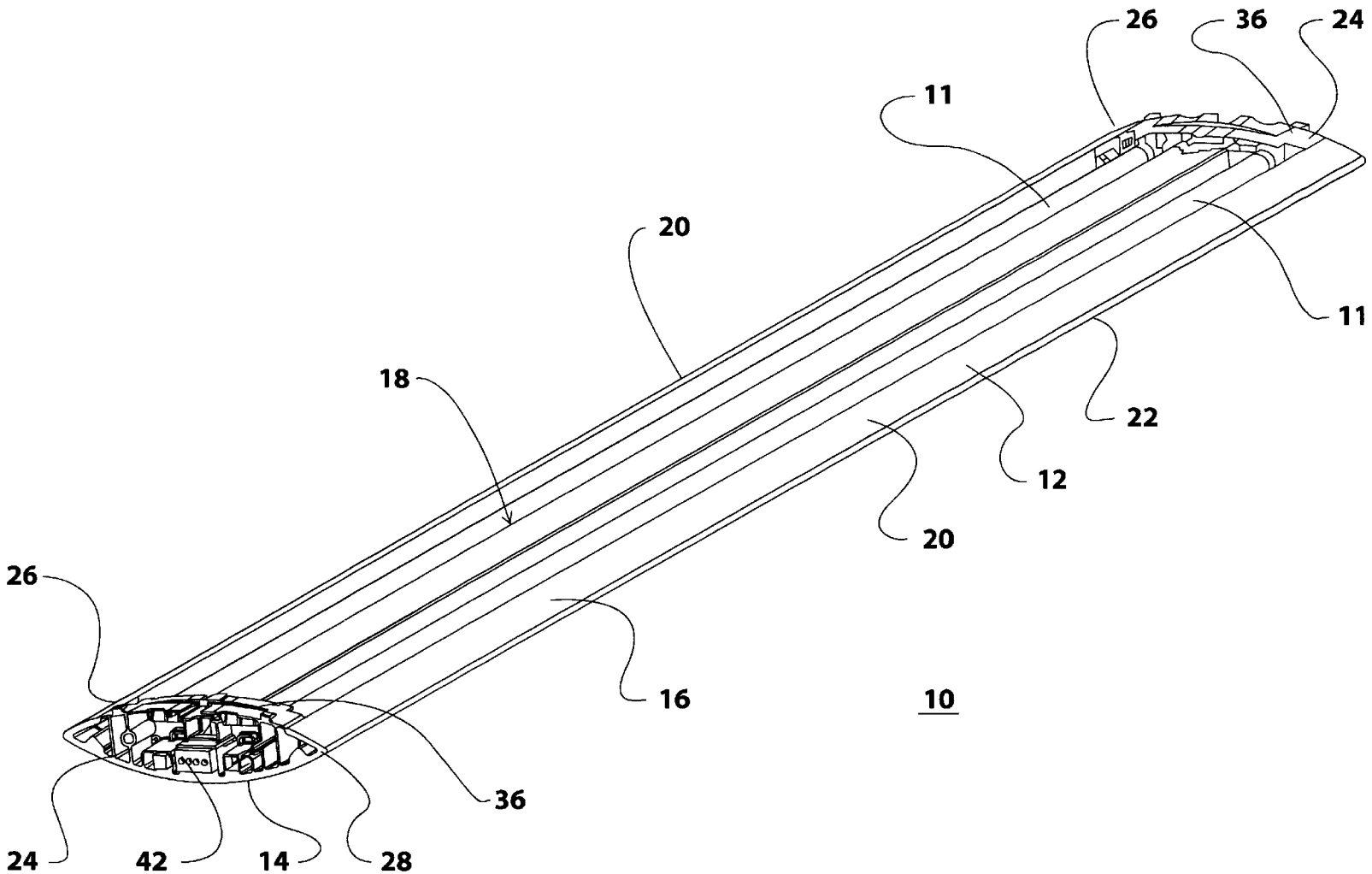
FIG. 1 is a perspective view of a linear lighting fixture of the preferred embodiment.
Figure 2:
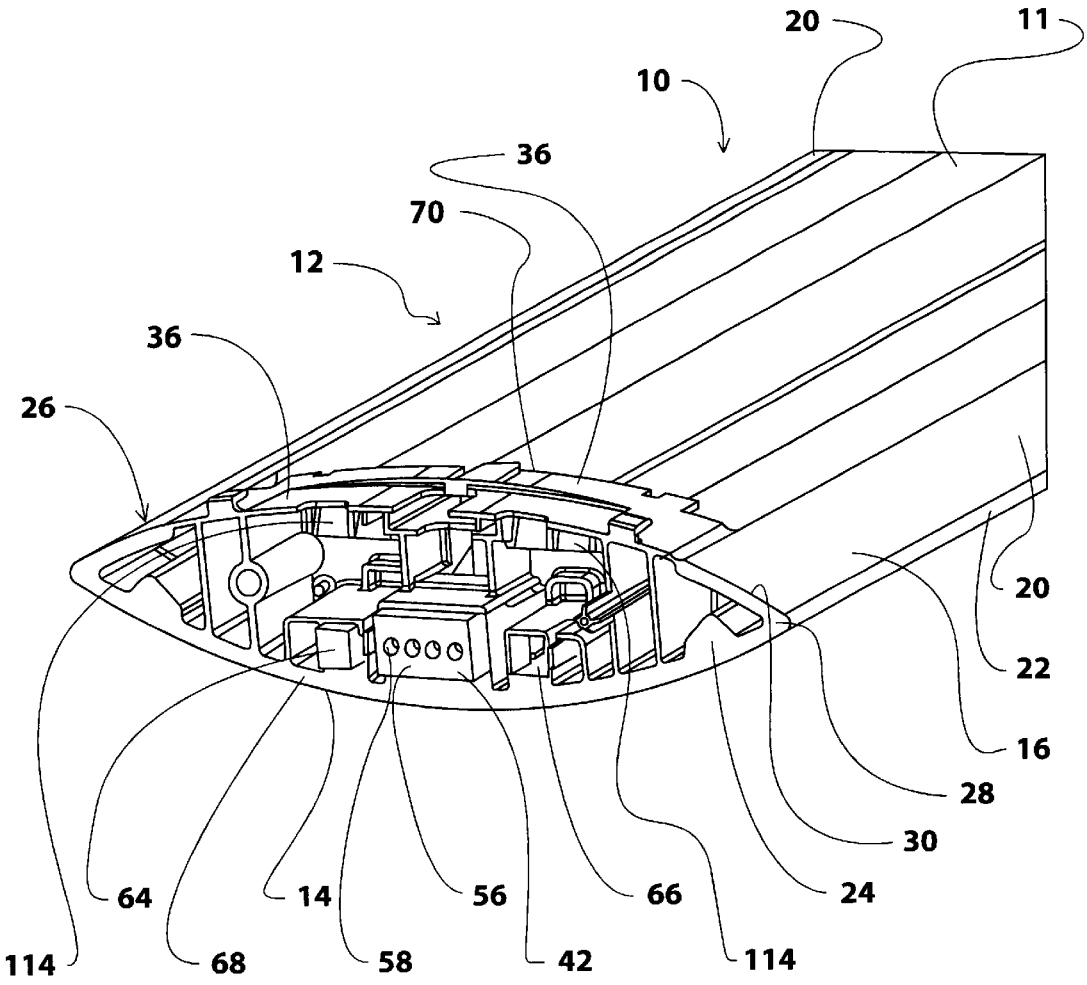
FIG. 2 is an enlarged partial end view of the linear lighting fixture of FIG. 1.

Referring to FIGS. 1 and 2, there is shown a linear lighting fixture 10 for suspension from an overhead structure. The linear lighting fixture 10 has fluorescent lamps 11 for the purposes of illuminating commercial, office, or home space. The fixture 10 has an elongated linear housing 12 that includes a bottom wall 14 and a top wall 16. The top wall 16 has an elongated slot 18 extending longitudinally along the top wall 16 of the housing 12. The elongated slot 18 extends the entire length of the lighting fixture 10 to divide the top wall 16 into two top wall surface portions 20. The housing 12 comprises an extruded aluminum material and is formed at with a corner 22 between the top wall 16 and bottom wall 14.

The linear lighting fixture 10 further includes a one-piece or molded piece plastic housing support 24 which is shown in FIGS. 1 to 5. Alternatively, the support 24 may be formed and assembled from multiple pieces. The plastic housing supports 24 are shown mounted within the housing 12 located at opposing end portions 26 of the housing 12. It should be understood that additional linear supports may be provided along the length of the housing 12 when the housings are of length to accommodate two or more fluorescent lamps 11 mounted through suitable connections in end to end relationship within one linear housing 10. The use of the molded plastic support 24 results in a weight reduction to a fixture of less than 12 pounds. Current building codes for such a lightweight fixture do not require additional suspension.

The housing support 24 is matingly inserted into the housing 12 between the housing top wall 16 and housing bottom wall 14. The housing support 24 has a peripheral flange 28 that abuts against edge or peripheral edges 30 of the housing bottom and top walls 14, 16 at the end portions 26. The abutment of the peripheral flange 28 against the peripheral edge 30 limits the insertion of the housing support 24 into the housing 12 and precludes or limits leakage of light from the end of the fixture 10. Further, the peripheral flange 28 of the housing support 24 provides a peripheral surface, which for the most part extends around the peripheral edge 30 of the housing support 24, providing a relatively flat surface that abuts against other flat surfaces of housing support of other adjoining linear lighting fixtures to be mounted in linear adjacent relationship with the fixture 10.

Figure 3:
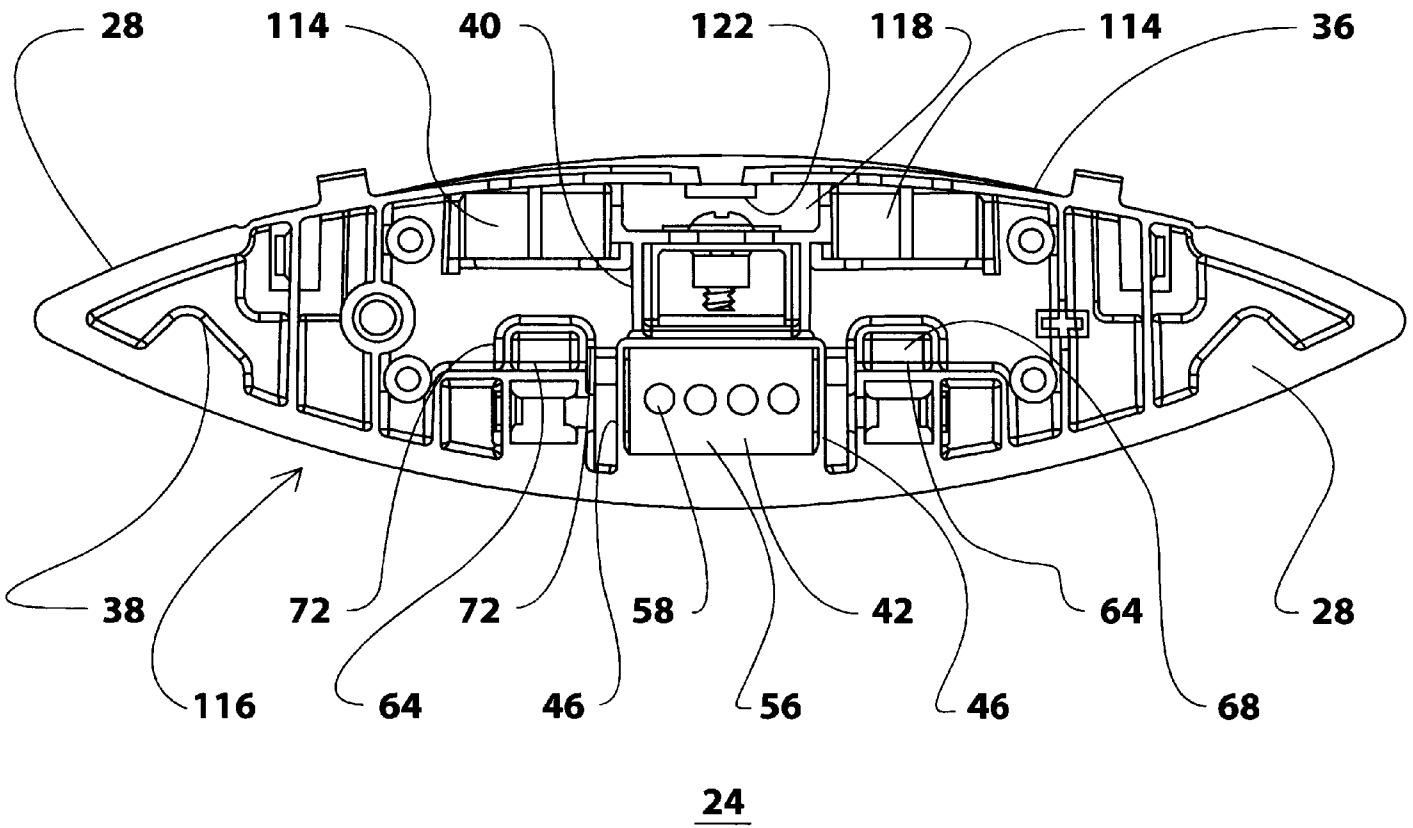
FIG. 3 is a front end view of the housing support of the linear lighting fixture.
Figure 4:
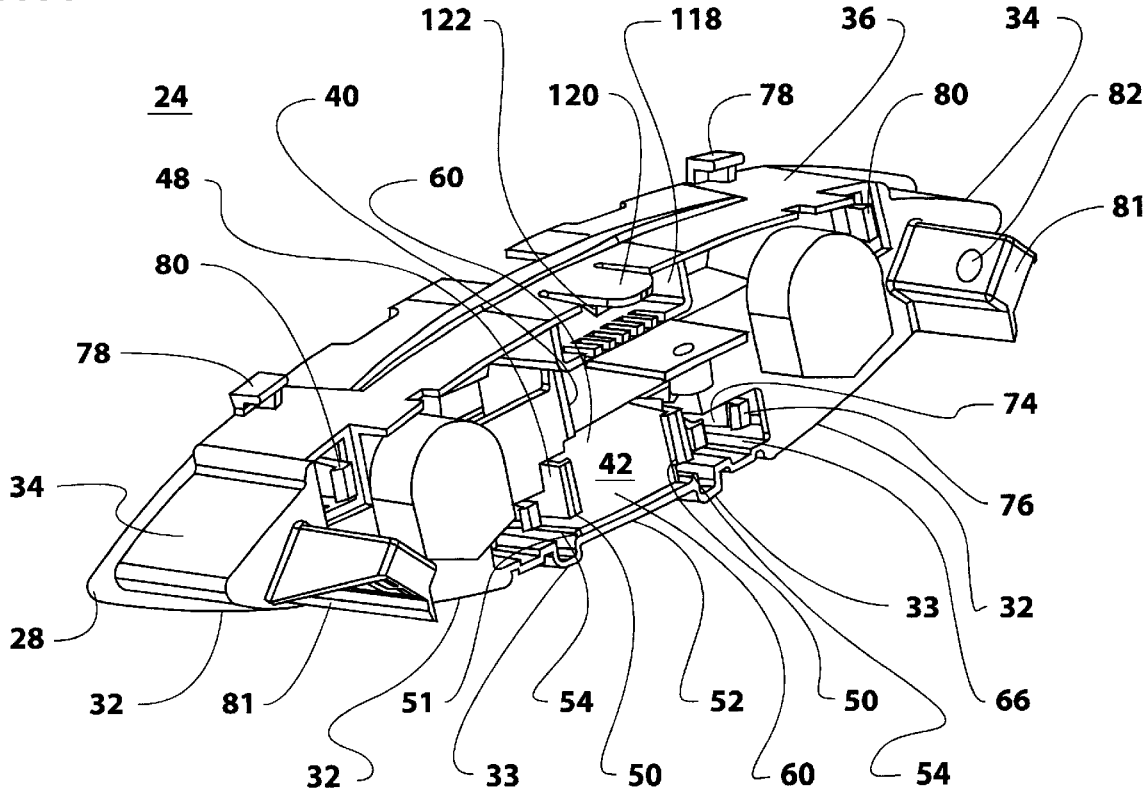
FIG. 4 is a rear end perspective view of the housing support of the linear lighting fixture.
Figure 5:
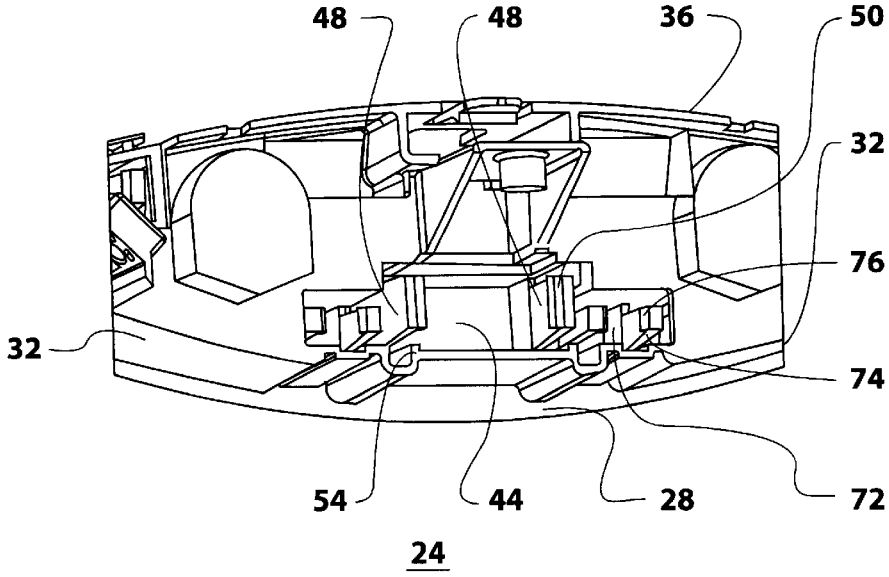
FIG. 5 is a partial rear perspective view of the housing support of the linear lighting fixture.

In FIGS. 3 and 4, the housing support 24 has bottom surface portions 32 and bottom surface ridges 33. The housing supports 24 further include top surface portions 34. The bottom surface portions 32, bottom surface ridges 33 and the top surface portions 34 conform in shape respectively to the housing bottom wall 14 and the housing top wall 16. Thus, the bottom surface portions 32 and the bottom surface ridges 33 act with the top surface portions 34 of the housing support to engage in mating slide fitting relationship the housing bottom walls or portions of these bottom walls 14 and portions of the top walls 16. The angle at which the top wall portions 20 are bent about corners 22 with respect to the bottom housing walls 14 may be chosen such that this angle is slightly less than the angle between the bottom surface portions 32 and the top surface portions 34 of the housing support 24. This will provide a tight fit for the housing support 24 when inserted into the housing 12. Further, the housing support 24 acts to support or maintain the elongated housing bottom wall 14 in a fixed spaced apart relationship from the housing top wall 16.

In the preferred embodiment shown in the drawings, the elongated housing bottom wall 14 and the elongated housing top wall 16 have a cross-sectional shape in the form of an eyelet with the elongated housing bottom wall 14 and the elongated housing top wall 16 meet at the corners 22 of the eyelet. The elongated slot 18 extends along the entire length of the elongated housing top wall 16 so as to provide two spaced apart housing top wall portions 20. Such an elongated slot 18 extending the entire length of the fixture 10, permits for significant material reduction and less material wastage in the production of the housing 12.

To provide additional strength to support the housing 12, the housing support 24 has a raised bridge surface 36 that extends transversely across the elongated slot 18 at end portion 26 of the housing 12. This raised bridge surface 36 provides a continuous or continuum in the surface across the end portions 26 between the elongated housing top wall surface portions 20.

The housing support 24 further has a series of ridges 38 and struts 40, which provide additional reinforcing strength in the housing support 24. The housing support 24 is further adapted to be suspended from an overhead structure. This feature of the housing support 24 is disclosed in more detail hereinafter.

The linear lighting fixture 10 thus far described has the advantage that it is a light weight fixture of a relatively thin gauge of aluminum sheet material extruded or formed into shape and the housing supports 24 are of molded plastic. It should be understood that the light weight linear lighting fixture 10 has advantage in that it is more easily handled by installers during installation from suspended structures which are sometimes in the order of 7 feet or more above the ground. Further, the lighter the fixture 10, the less support required from the overhead structure to support the fixture 10.

Referring again to FIGS. 1 through 5, another feature of the end support 24 is shown as a plug type electrical connector 42 housed within the support 24. The supports 24 further include a first socket or first connector recess 44 that extends through the housing support 24. From the drawings it will be seen that the connector 42 is generally in the shape of a rectangular cross-section and the shape of the connector recess 44 also follows the shape 42 of the electrical connector. The electrical connector 42 is shown to be a plug type connector. In the particular drawing shown, four circular apertures are shown as female apertures for reception of a male connector. It should be understood that the connector 42 may be a male or a female connector or may be both in that it could be a coaxial type of connector. In accordance with the present invention, the type of connector used for transferring of electrical power or control signals between adjacent mounted linear lighting fixtures 10 is a plug type connector. That is for the purposes of the present invention, the connectors 42 of two adjacent linear lighting fixtures 10 are adapted to abut and matingly engage each other when the linear lighting fixtures 10 are mounted in side by side longitudinal abutting or adjoining relationship.

Because the shape of the first connector recess 44 conforms to the shape of the first electrical plug connector 42, the first electrical plug connector 42 is seated in a partially mating relationship with the first connector recess. The first connector recess 44 has a pair of opposing support walls or side support walls 46 which engage the first plug connector 42 to seat the first plug connector in the first connector recess 44. The first connector recess 44 further includes a pair of opposing converging cantilever walls 48, which further include in-turned hook members 50 which engage a rear surface of the connector 42. In FIG. 4, the housing support 24 has a bottom wall portion 52 extending between the bottom surface ridges or ribs 33 and below the connector 42. The bottom wall portion 52 has two upstanding ribs 54 that are further adapted to matingly engage or positively locate the electrical connector 42 seated within the first connector recess 44. The hook members 50 engage the first electrical plug connector 42 to positively locate the travel of the first electrical plug connector 42 into and through the first connector recess 44. The first electrical power connector 42 has a front face 56 having connection terminals 58 facing outwardly of the housing 10 and the end portions 26 of the housing 10. The plug connector 42 has a rear surface 60 with electrical wiring (not shown) extending therefrom for connection with ballast or other circuitry housed within the linear lighting fixture 10.

The electrical connector 42 is readily inserted into the end support 24 by threading the wire through the open recess or first connector recess 44 and then fitting the first electrical connector 42 in sliding mating relationship into the first connector recess 44 until the converging cantilever side walls 48 and the hook members 50 engage the connector 42. This provides for easy assembly of the electrical connector 42 within the end support 24. This also provides for the housing support or end support 24 to be readily inserted into the housing 12 in a plant facility with the wiring or wires 62 connected at the manufacturing facility to a ballast. Consequently, no additional wiring in the field is required during installation for the fixture.

The housing supports 24 located at each end portion 26 of the housing 12 have two additional second electrical control plug connectors that are seated in second connector recesses 66. The second plug connectors 64 have a front face 68 having a connection terminal facing outwardly of the housing for connection with a control source. The second plug connectors 64 have a rear face (not shown) with electrical control wiring extending from the second plug connector 64 through the housing support 24 and into the linear housing 10. The construction of the support walls of the second connector recess 66 is similar to that for the first connector recess 42. That is to say, the connector recess 66 includes second supporting opposing support walls or side walls 72 which engage the second plug connector 64 to seat the second plug connector 64 in the second connector recess 66. The second connector recess 66 further includes rearwardly extending opposing cantilevered walls 74 that converge and are provided with in-turned hook members 76 which are mounted to the cantilevered walls 74. The in-turned hook members 76 are in-turned to engage the second electric plug connector 64 and to positively locate the travel of the second electrical plug connector 64 into and through the second connector recess 66.

Figure 6:
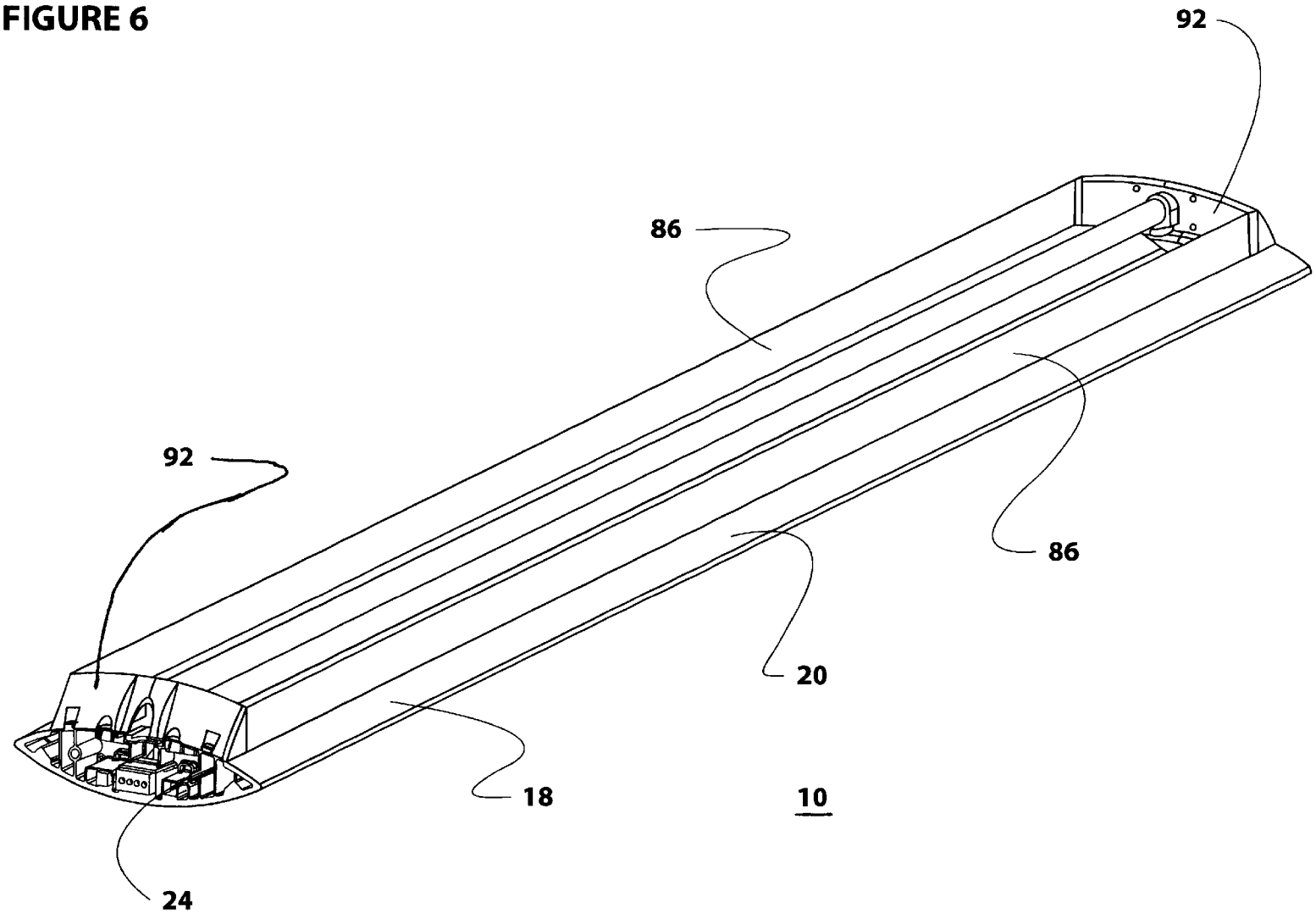
FIG. 6 is a perspective view of an alternative embodiment of the linear lighting fixture showing the use of a riser extension.
Figure 7:
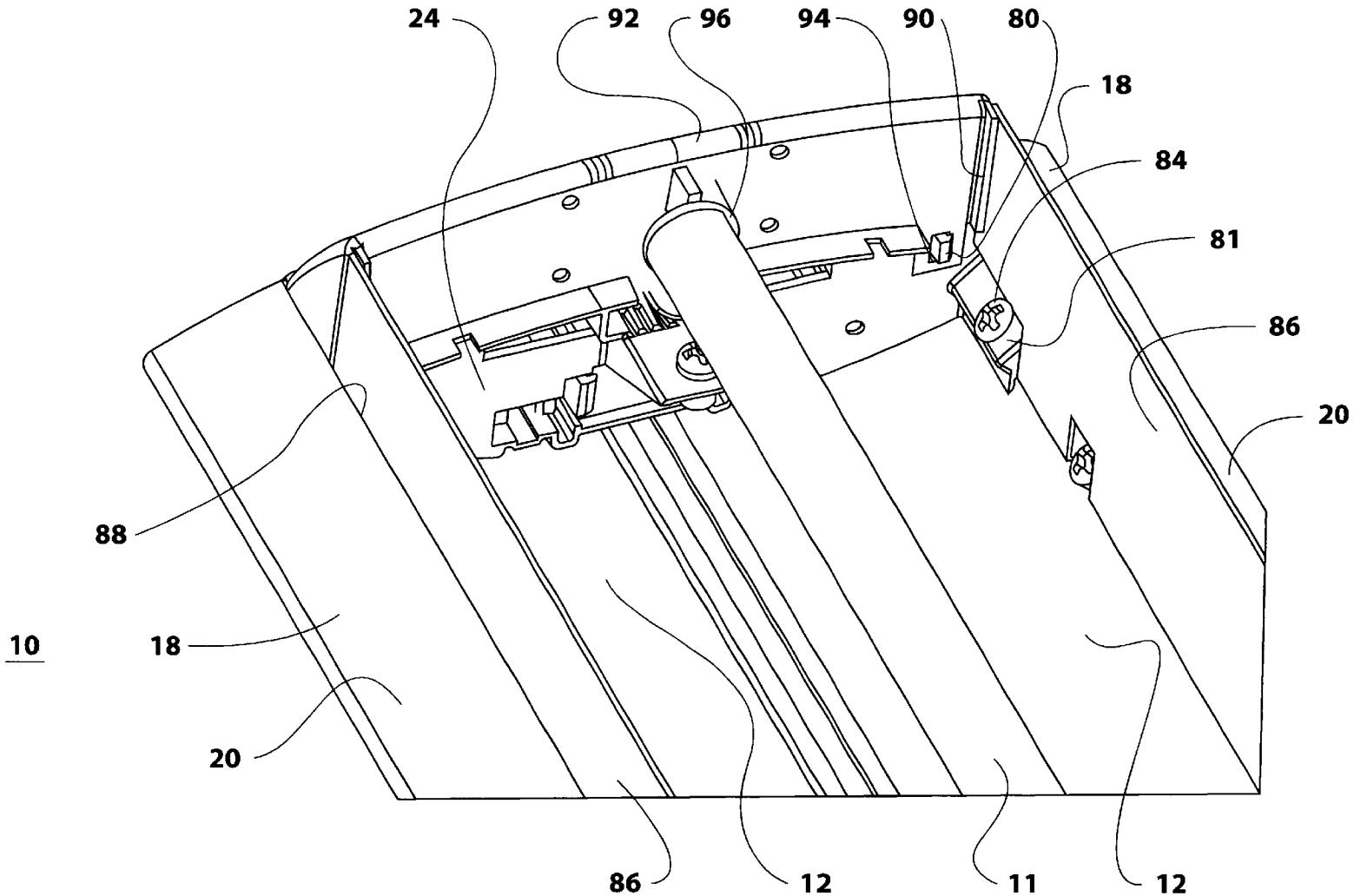
FIG. 7 is an enlarged partial perspective view of the linear lighting fixture of FIG. 6.
Figure 8:
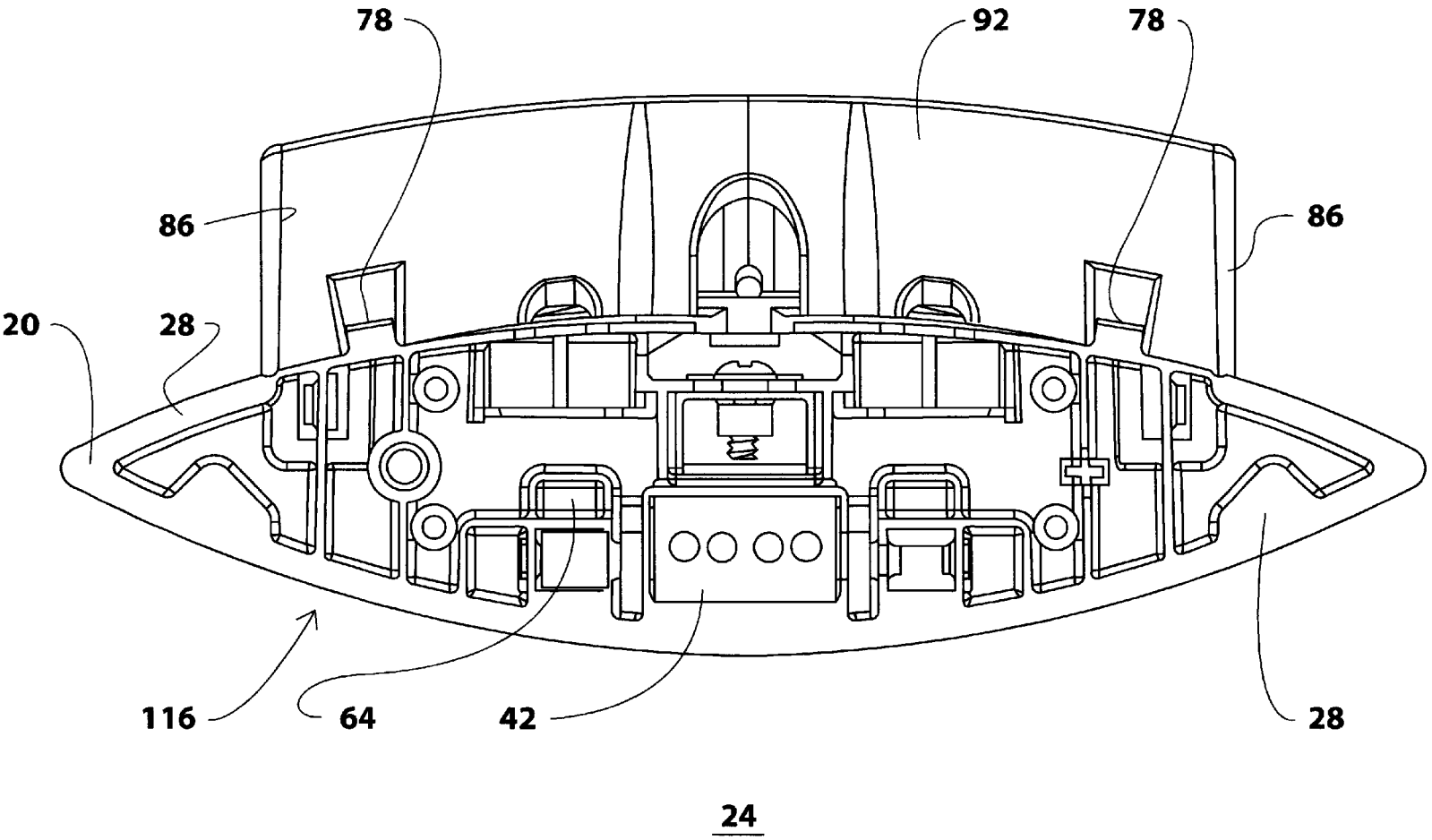
FIG. 8 is an end view of the housing support and riser of the linear lighting fixture of FIG. 6.

Referring to FIG. 4, there is shown on the bridge surface 36 of the support 24 a pair of opposing locking tabs 78 and a pair of spring tab hooks 80 below bridge surface 36. Also provided on the support 24 are rearwardly or inwardly facing ears 81 having openings 82 through which locking screws 84 (FIG. 7) pass. The purpose of the locking tabs 78, hooks 80, and ears 81 is to provide for a riser support or member 92 for supporting a lamp fixture 11 as shown in FIGS. 6, 7, and 8. In these figures, the lamp 11 is located at a raised elevation relative to the housing 10 and the housing support 24. This type of fixture is provided to have a different lighting effect. In the fixture shown in FIGS. 6 and 7, two elongated housing side walls 86 extend the length of the adjacent respective top wall portions 20. The two elongated housing side walls 86 are secured relative to the top housing wall 18 and the bottom housing wall 14 by means of locking screws 84 extending through the opening 82 and ears 81 to positively locate one side surface of the side walls 86 in force, abutting relationship against the in-turned edge 88 of the housing top wall portion 20. The side walls 86 are further mounted in place in abutting relation at their end against flanges 90 which form part of a riser member 92. The riser members 92 are mounted by sliding edge portions thereof over the hook 78 and are also provided with openings 94 to hook members 80 of the housing support 24 extend. The riser member 92 is further provided with a socket 96 adapted to receive the lamp 11. This feature of being able to modify the construction of the linear lighting fixture 10 to include the riser support 92 and the additional or alternative lamp 11 allows for the manufacture of a more flexible linear lighting fixture 10.

Thus far, in the description of the preferred lighting fixture 10 of the present invention, the description has been limited to the construction of the fixture 10 itself to include a housing 12 and a housing support 24. Further modification to the housing 12 has been provided by the addition of housing side walls 86 and a riser member 92. As is stated previously, the housing support 24 may be further adapted to support the linear lighting fixture 10 from an overhead structure. The housing support 24 is also previously described to include a peripheral flange 28 which was adapted to lie flush in mating engagement or abutting relationship with another end support 24 and the linear lighting fixture 10. To explain this feature of the linear lighting fixture and in particular the housing support 24, reference is made to FIGS. 9 through 20 for which a linear lighting fixture suspension system is shown.

Referring to FIGS. 9 through 12, there is shown a suspension system 98 for suspending adjacent end portions 26 of the first linear lighting fixture 100 and a second linear lighting fixture 102 that extend generally along longitudinal axis 103. The suspension system suspends the linear lighting fixtures 100, 102 from overhead structure 108 in a manner to be hereinafter described.

Previously, reference had been made to housing supports 24. For the purposes hereinafter described, these housing supports 24 are referred to as joiner supports 24. All similar features and numbers will be used for the joiner supports 24 as have been used previously for the housing supports 24. The term joiner supports 24 is used in this aspect of the present invention to further exemplify that the supports 24 have a function that goes beyond the supporting the housing of the linear lighting fixture to that of supporting adjoining linear lighting fixtures 100 and 102. The joiner supports 24 are shown as before mounted to each of the adjacent end portions 26 of the first and second linear lighting fixtures 100, 102. The jointer supports 24 have their peripheral flanges 28 shown in abutting relationship in FIG. 9. These flanges 28 are brought into abutment during the assembly of the fixtures 100, 102 on the suspension system 98. The joiner supports 24 have a pair of spaced apart inclined clamping walls 114 which are shown in FIGS. 2 and 3 mounted from or suspended from the bridge surface 36 of the joiner support 24. The inclined clamping walls 114 are further shown in the cross-section of FIGS. 11 and 12. Each of the inclined clamping walls 114 is accessible from a respective end portion of the joiner support 24 which is labeled numeral 116 showing the view into the end of the joiner support 24 of FIG. 3. Each of the clamping walls 114 slopes upwardly of the longitudinal axis 103 and inwardly of the respective end portion 116 or the end portion defined by the peripheral flange 28 of the joiner support 24.

The adjacent joiner supports 24 of the fixtures 100 and 102 have first adjacent alignment receiving slots 118. The alignment receiving slots 118 each have a depending finger 120 that extends rearwardly of the bridge 36 of the joiner support 24. The depending finger 120 has a transverse rib 122.

Mounted within the lighting fixtures 100 and 102 is a reflector support 124 which is located by a locating screw 126. The locating screw 126 serves another purpose, which is discussed hereinafter.

Figure 14:
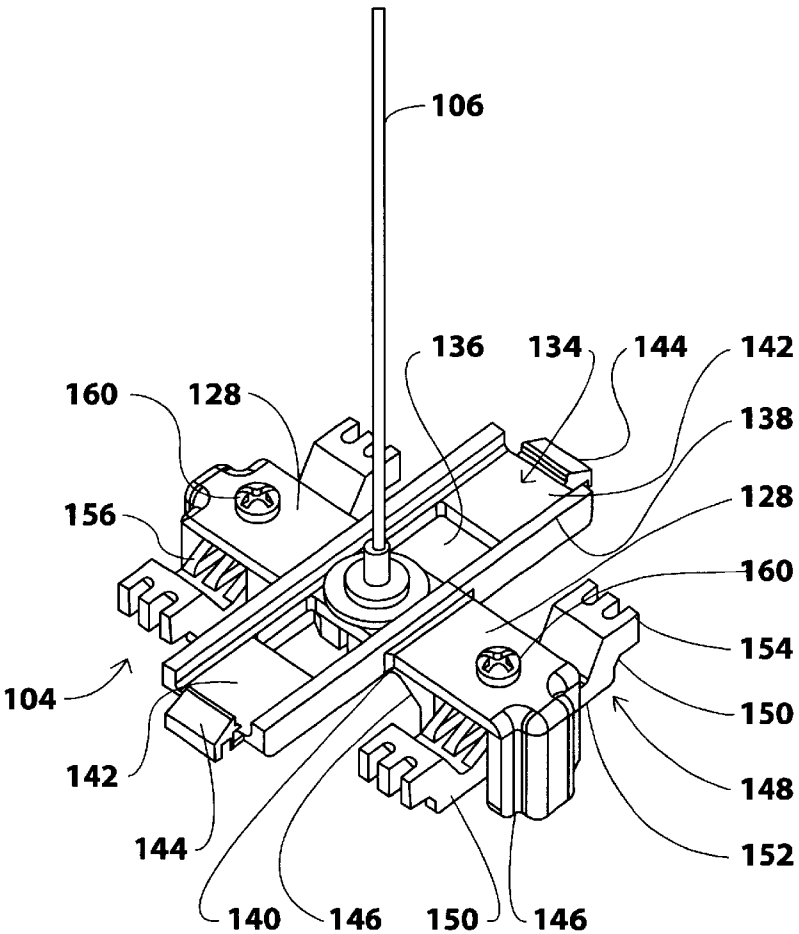
FIG. 14 is a perspective view of the hanger member of FIG. 13.
Figure 13:
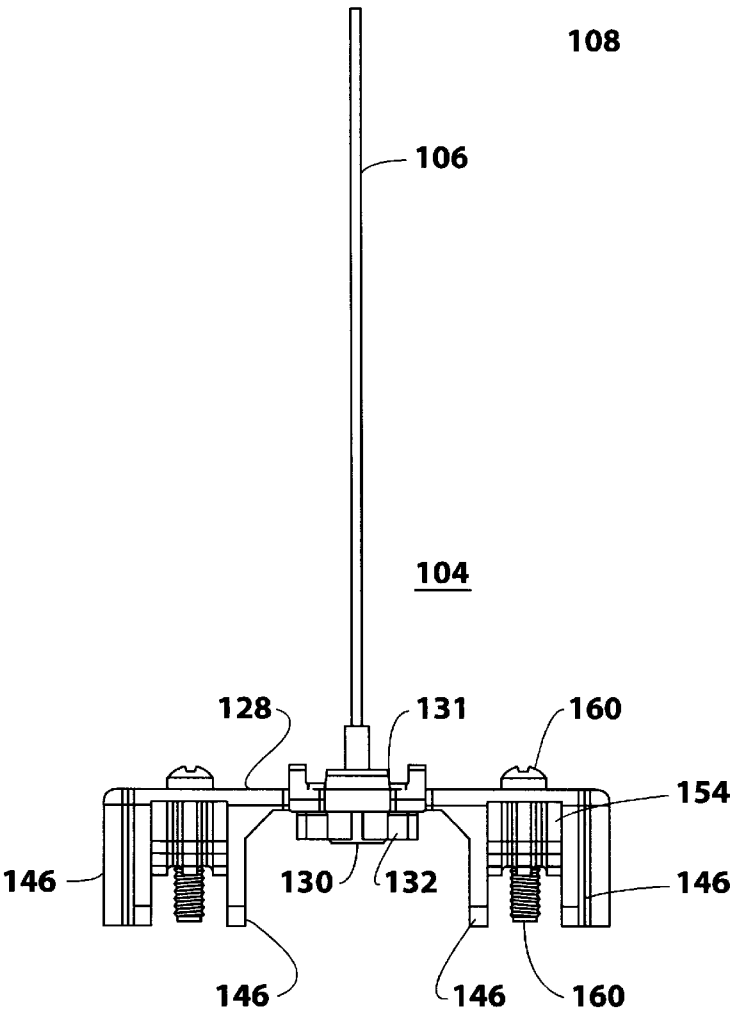
FIG. 13 is a side view of the hanger member used to suspend the linear lighting fixtures.
Figure 15:
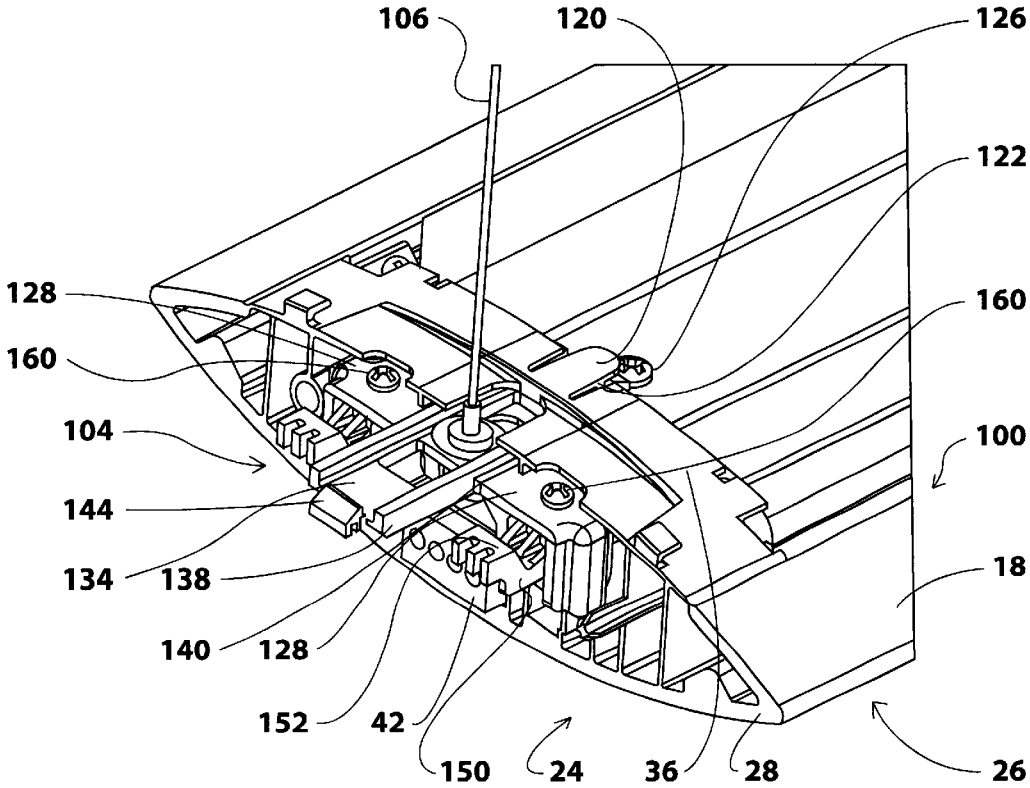
FIGS. 15 and 16 are partial perspective views showing the insertion of the hanger member in a joiner support in accordance with the connection as shown in FIG. 11.
Figure 16:
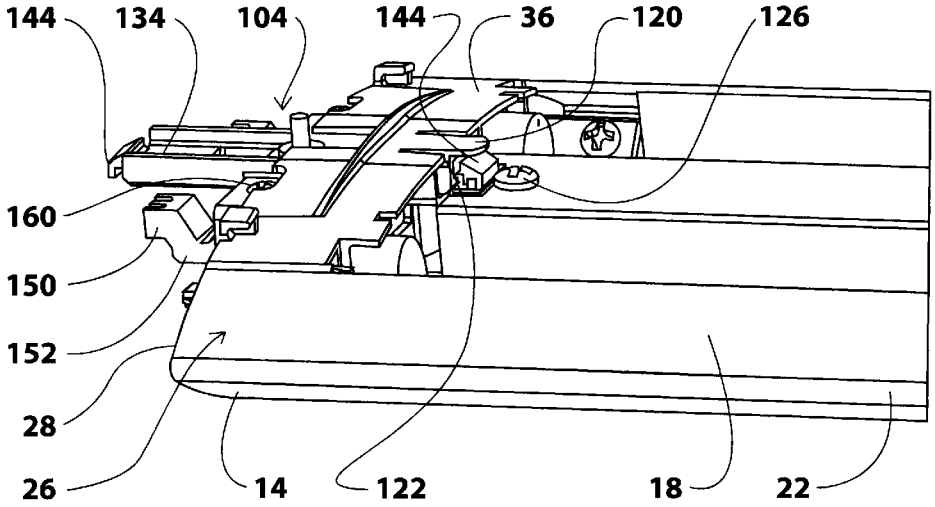
Figure 17:
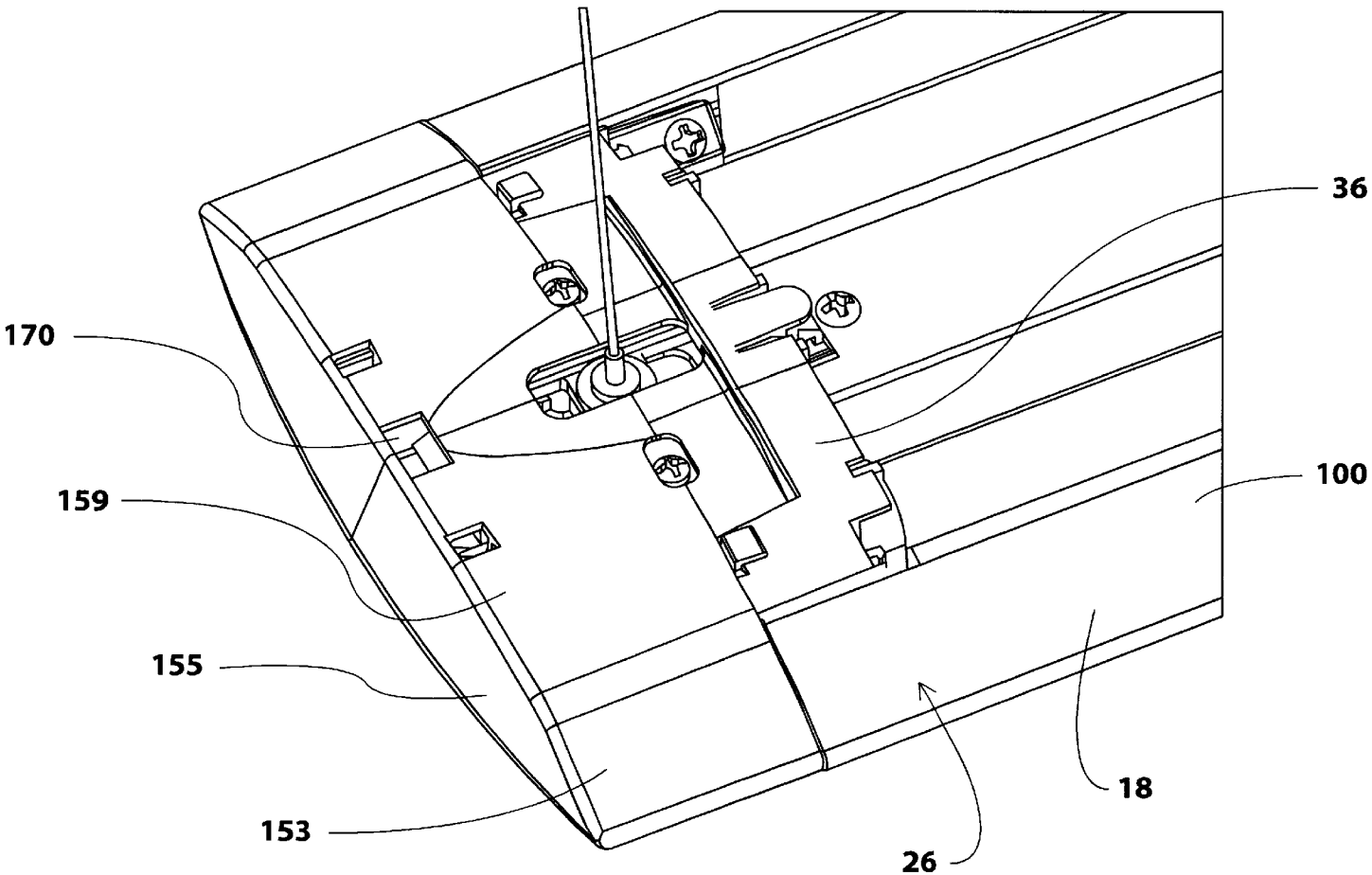
FIG. 17 is a perspective view showing the suspension of a linear lighting fixture and end cap from the preferred suspension system.
Figure 18:
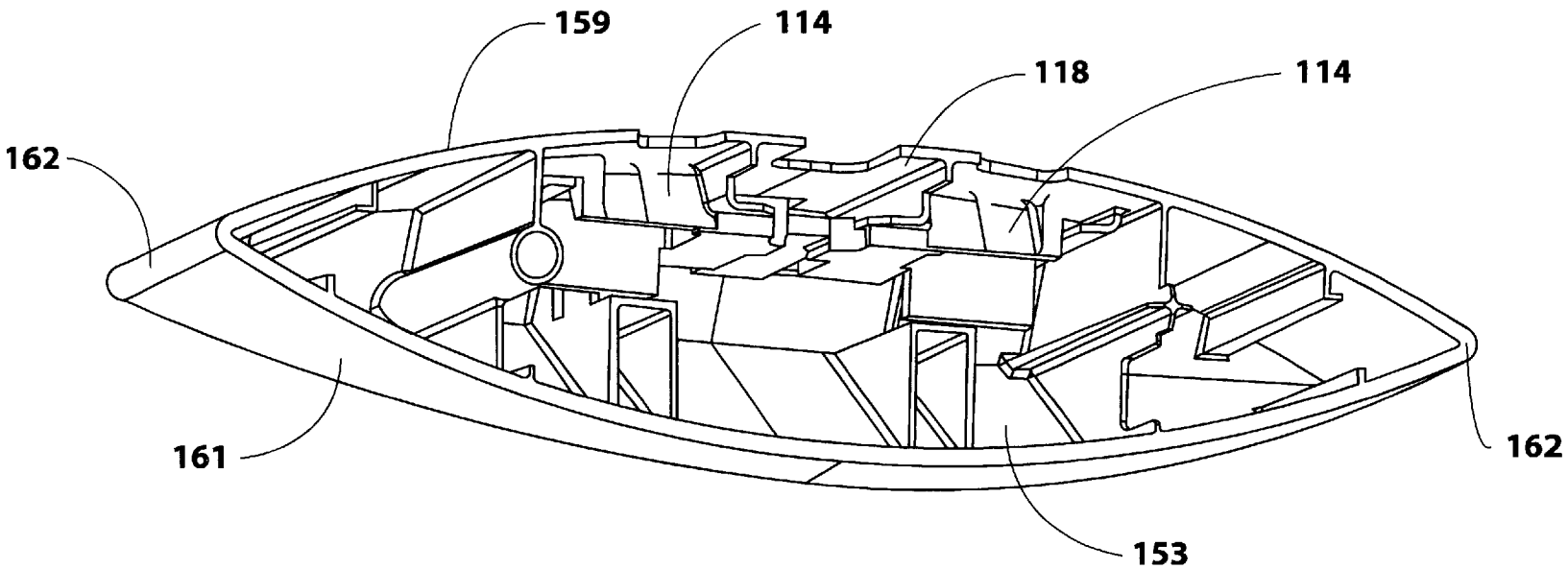
FIG. 18 is a perspective end view of the cap.
Figure 19:
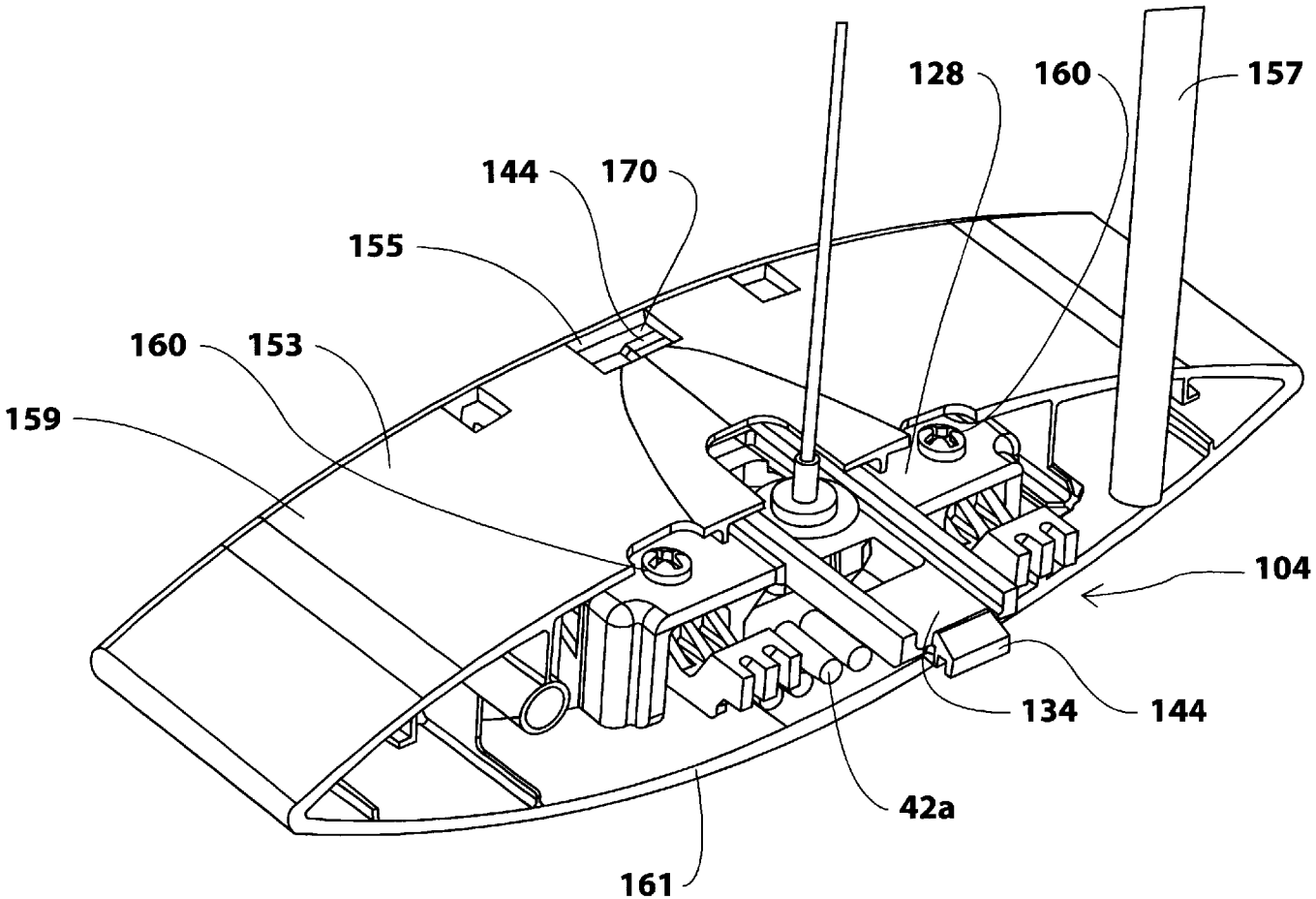
FIGS. 19 and 20 are perspective views showing the hanger member mounted in the end cap.

The suspension system further includes a hanger member generally designated 104 and shown as a component part in FIGS. 13 and 14. The hanger member 104 is suspended from the overhead structure 108 by wire 106. The purpose of the hanger member 104 is to support the first and second linear lighting fixtures 100 and 102 from the overhead structure 108.

The hanger member 104 has a bridge member 128 adapted to extend transversely of the longitudinal axis 103. The bridge member 128 has an opening 131 through which the wire 106 passes to a washer 130 mounted within a socket 132. The washer 130 mounted within socket 132 permits for relative floating of the bridge member 128 with respect to the wire 106 so that the bridge member 128 may be suspended in a plum fashion from the overhead structure 108.

The bridge member 128 has an elongate alignment member 134, which in turn has an opening 136 therein to allow for the wire 106 and washer 130 assembly to be mounted to the bridge structure 128. The elongate alignment member 134 has side walls 138, which are seated within guide walls 140 of the bridge member so as to positively locate the alignment member 134 to the bridge member 128. The alignment member 134 has a pair of opposing tongues 142. The pair of opposing tongues 142 or tongue insert portions 142 are adapted to extend along one of the adjacent alignment receiving slots 118. The tongue portions 142 are terminated in an upwardly directed resilient hook member 144. The tongue portions 142 have a width less than the width of the receiving slots 118 to permit relative lateral movement therewith.

The bridge member 128 has two downwardly depending ribs or side wall supports 146. Suspended between the ribs 146 from each side of the bridge, 128 is a generally V-shaped wing member 148 having two spaced apart wings 150 and a central interconnecting member 152. The ends of the wings 150 are shown with a series of reinforcing fingers 154 and the central portions of the interconnecting member 152 are shown with a series of reinforcing ribs 156. A vertically adjustment screw 160 passes through the bridge member 128 between side supporting walls or ribs 146 to support or hold the interconnecting member 152 in a depending fashion from the bridge member 128.

Figure 9:
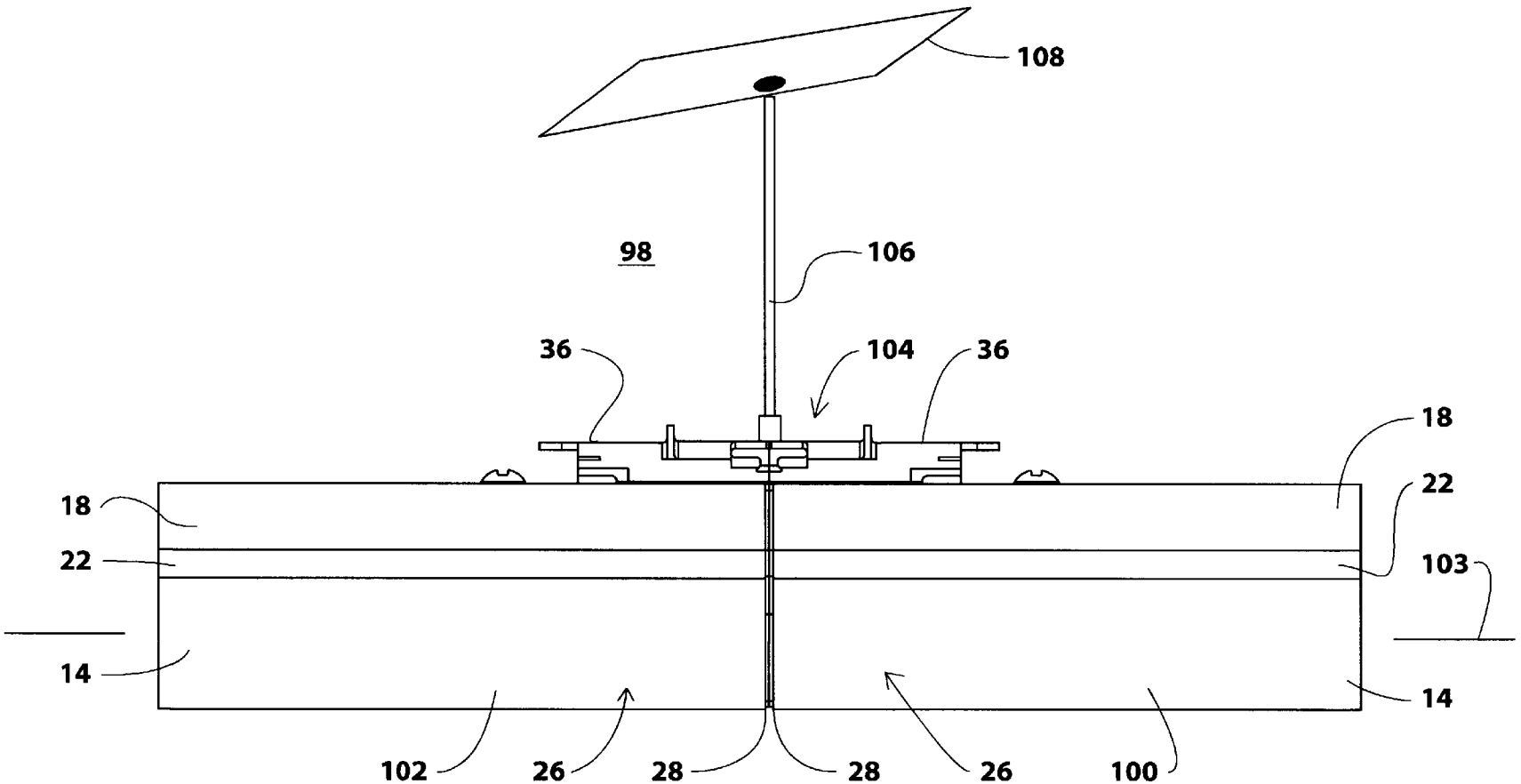
FIG. 9 is a side elevational view showing the suspension system for suspending two linear lighting fixtures from an over-head structure.

The assembly of the two linear lighting fixtures 100 and 102, as shown in FIG. 9, is described with reference to FIGS. 10 to 12.

Figure 10:
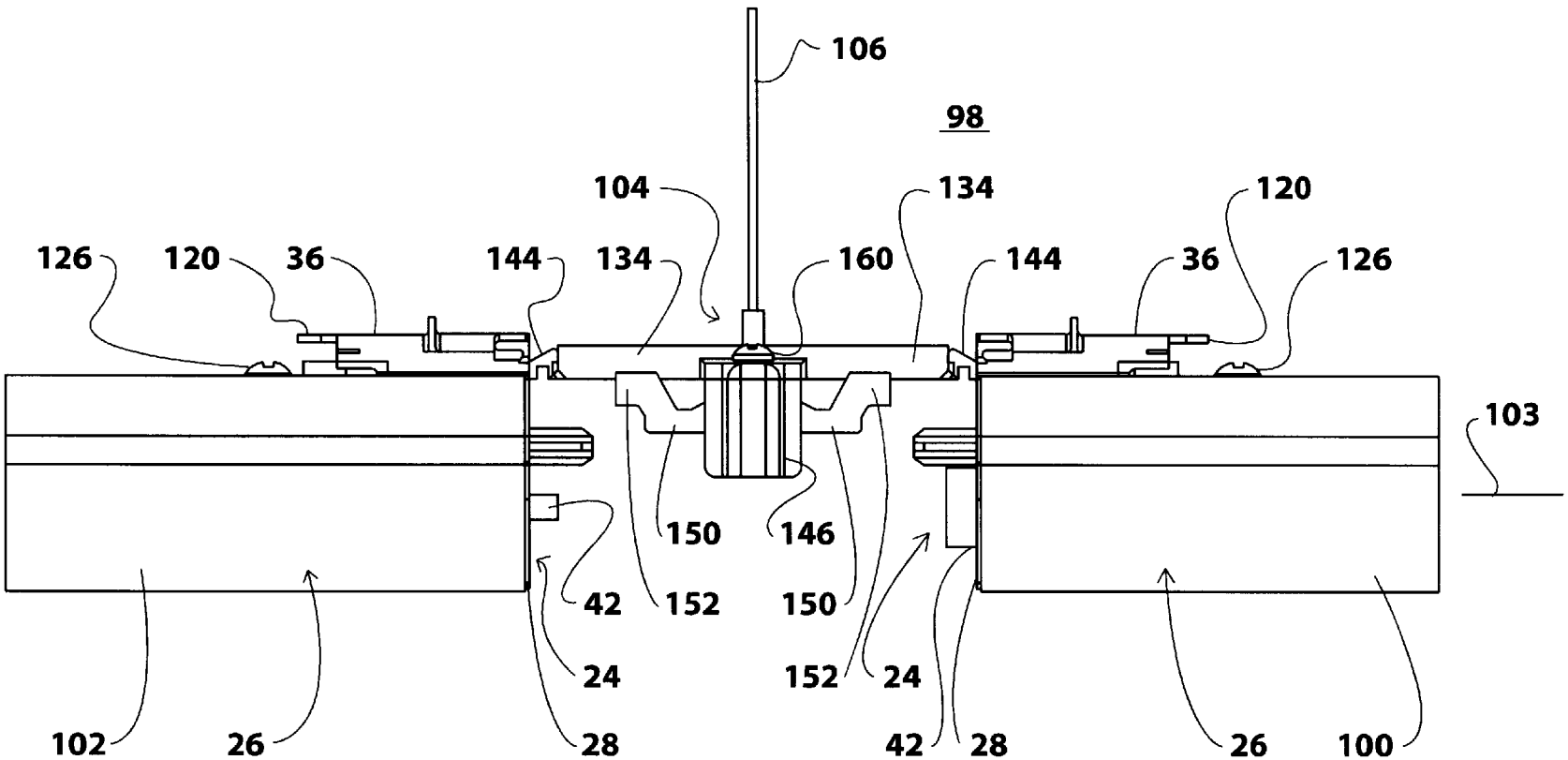
FIGS. 10 to 12 show the stages of connecting and suspending the linear lighting fixtures prior to complete assembly as shown in FIG. 9.

In FIG. 10, the hanger member 104 is suspended from the overhead structure 108 by wire 106. Next, the linear lighting fixtures 100 and 102 are positioned adjacent to the hanger member 104. It should be understood that for the purposes of this drawing, the two linear lighting fixtures are shown positioned along a longitudinal axis 103. However, in practice, one linear lighting fixture would be orientated along linear axis 103 for temporary connection to the hanger assembly 104 and then the second linear lighting fixture 102 is also temporarily connected to the hanger assembly 104 prior to secure connection. By temporary connection it is meant that the loose connection of the linear lighting fixtures 100 and 102 as shown in FIG. 11.

Figure 11:
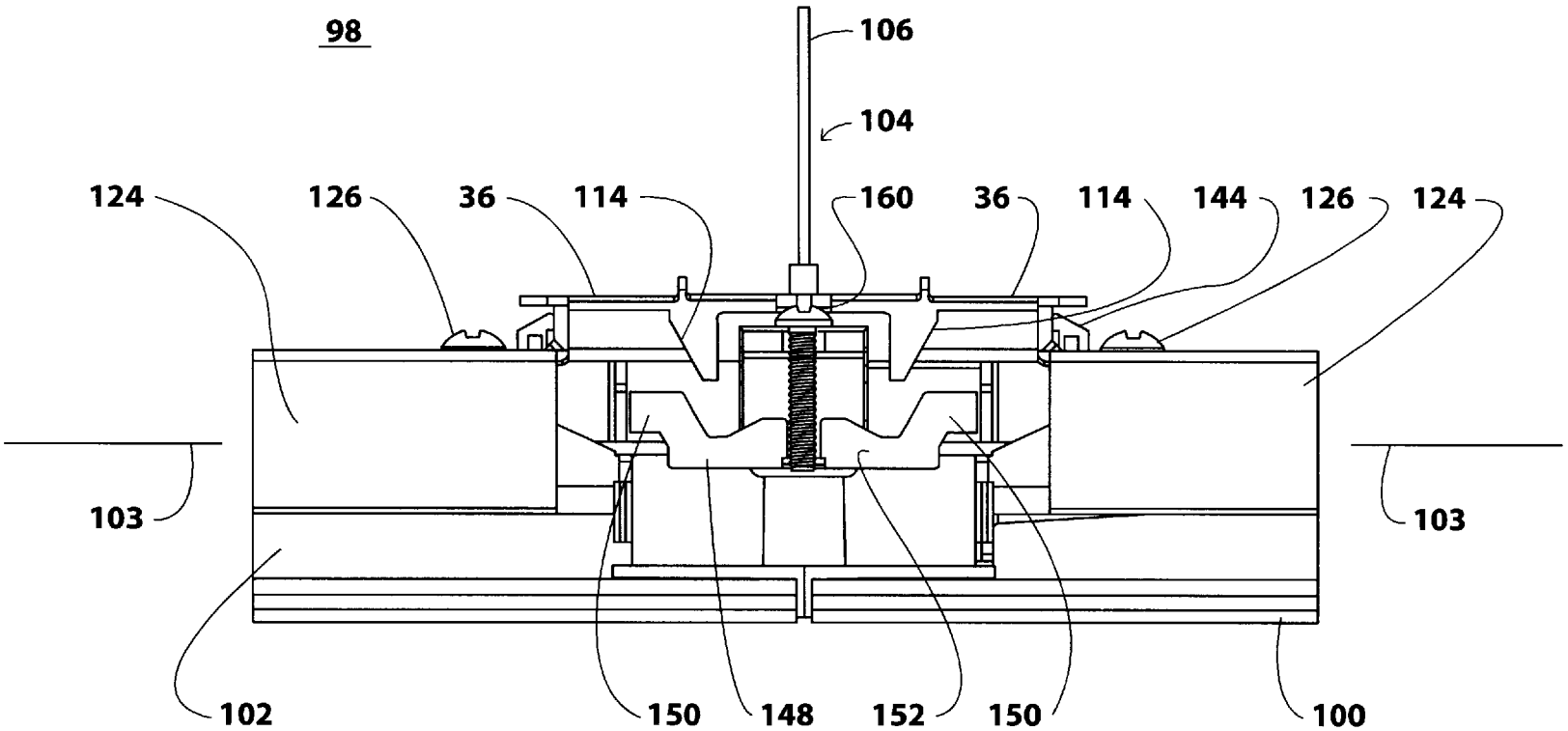
Figure 12:
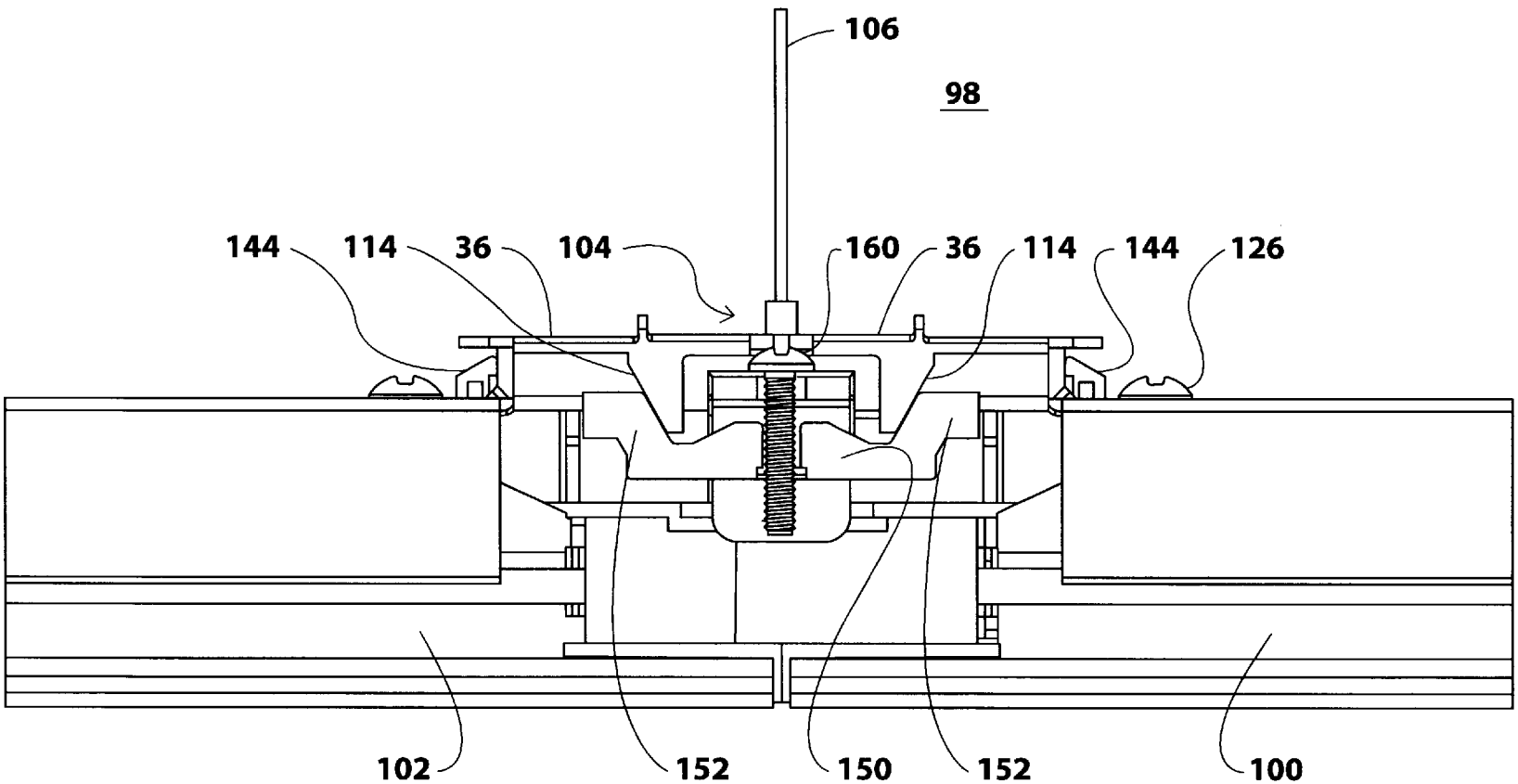

In FIG. 11, the elongate alignment member 134 has been inserted into the alignment receiving slot 118 of the joiner support 24. The alignment member 134 has its corresponding tongue portion 142 inserted into alignment receiving slot 118 until the hook 144 passes the tongue 120 and is locked in place relative to the depending rib structure 122. Once either fixture 100 or fixture 102 is so connected, the other fixture 100 or 102 may also be so connected. It should also be noted from FIG. 11 that the wing-shaped clamping member or clamp comprising the interconnecting member 150 and the wings 152 are positioned adjacent and in loose relationship with the ramp or clamping inclined walls 114 of the joiner support 24. This permits for a loose mechanical connection of the linear lighting fixtures 100 and/or 102 relative to the hanger member 104 for relative longitudinal and lateral adjustment. Once so connected, the linear lighting fixtures 100 and 102 do not have to be physically supported by an installer. Furthermore, the assembly of the elongate support member 134 within the first alignment receiving slot 118 is a loose connection which provides for some relative movement between the linear lighting fixtures 100 and 102 and hanger member 104.

Referring to FIG. 10, the connectors 42 of each of the end portions 26 is shown with a male connector on the linear lighting fixture 102 and the female connector on the linear lighting fixture 100. These plug connections 42 are partially or temporarily made during the assembly of the hanger member 104 as shown in FIG. 11. To complete the assembly and insure a proper mechanical and electrical interconnection between the linear lighting fixtures 100 and 102, the adjustment screws 160 are rotated to draw up the interconnecting member 150 of the wing shaped clamps 152 so as to bring the wings 152 up into sliding clamping engagement with the inclined walls 114 of the joiner supports 24 as shown in FIG. 12. This tightly locks the two linear lighting fixtures 100 and 102 in abutting and adjoining relationship with the hanger member 104, whereby the peripheral flanges 28 of the joiner supports 24 abut one another. It also brings the plug connectors 42 into tight electrical contact with each other.

By providing such a system of suspension and connection between two linear lighting fixtures 100 and 102 extending along the same longitudinal access 103, it is possible to have a temporary supported connection and then have this connection firmly made or disengaged. Furthermore, the linear lighting fixtures 100 and 102 may be readily disassembled by releasing the screws 160 to drop the wing shaped clamp members 152 out of engagement with the inclined clamping walls 114 and then lifting the tab 120, so as to release it from hook 144 so that the elongate member 134 may be removed from the alignment receiving slot 118. This provides for a flexible linear lighting fixture assembly which may be readily assembled and disassembled to accommodate for different changes in lighting fixture patterns.

Figure 20:
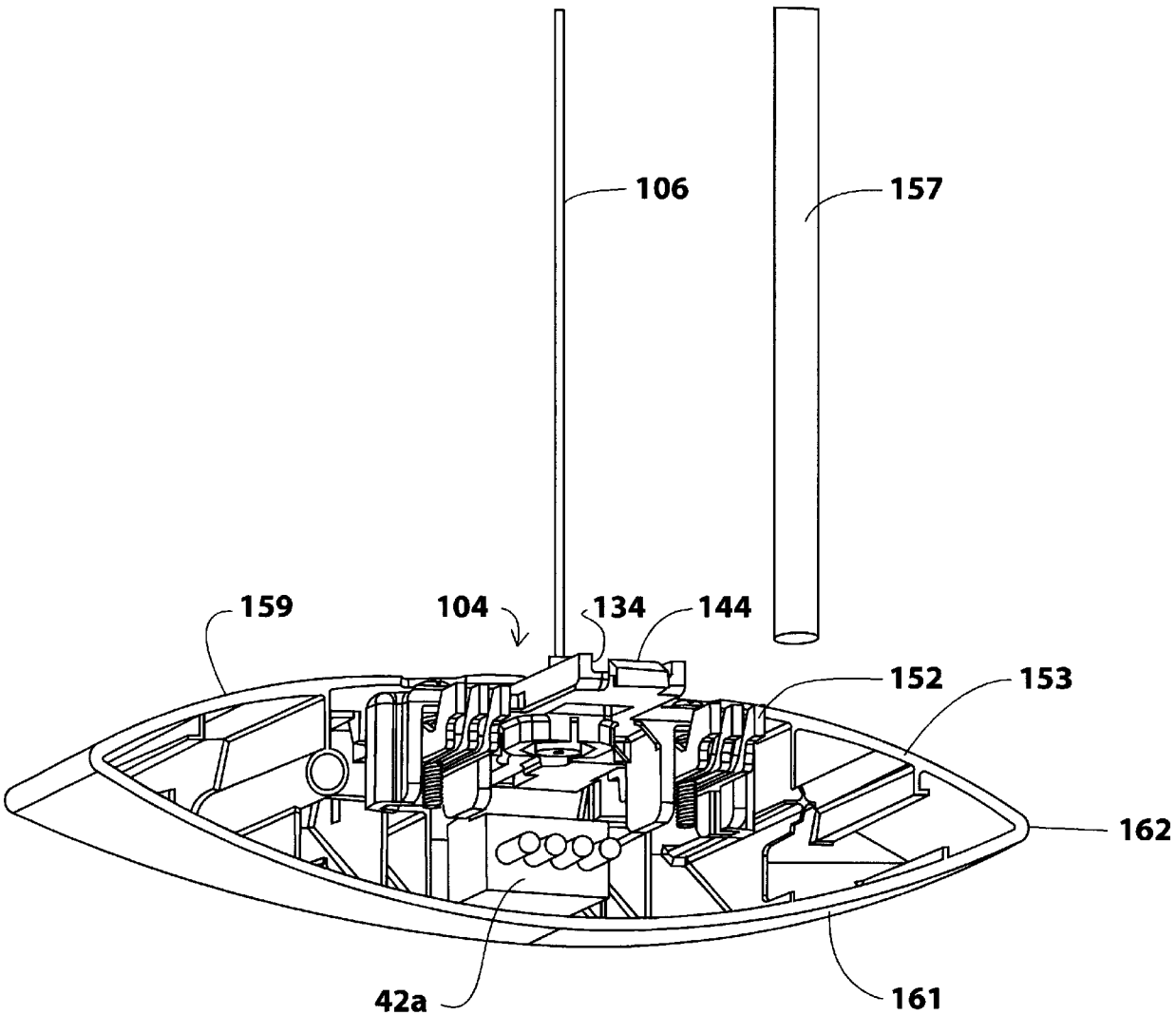

Referring to FIGS. 17 through 20, there is shown an end cap 153 which is adapted to close off the end portion 26 of the fixture 100. The end caps 153 are utilized in the present invention where the linear extension of the lighting fixtures comes to an end. The end caps 153 provide for a cosmetic and esthetically pleasing cover for the linear lighting fixture 100 while at the same time providing for a source of power 157 (FIG. 20) through opening 170 into the male plug connector 42*a* (FIG. 20).

The end cap 153 has an end wall 155, a top wall 159, a bottom wall 161 and edge 162 where the top and bottom walls 158 and 160 meet. The general shape of the end cap 153 is in that of an eyelet and conforms to the shape of the end portion 26 of the fixture 100. The end cap 153 has an alignment receiving slot 118 and a pair of inclined ramp walls 114 similar to those disclosed previously. The end cap 153 has a power receiving slot 170 adapted to receive wire 157 (FIG. 20, the connection not shown to simplify the drawing). Wire 157 is connected to connector 42*a*.

Typically, the hanger 104 is inserted into the end cap 153 in a manner identical to that previously described for fixture 102 relative to fixture 100. The hook members 144 pass through an opening 164 in the top wall 159 of the end cap 153. The end cap may have a plastic insert that is snap fitted into place to provide for the ramping surfaces 114 and the completion of the alignment receiving slot 118. The end cap 153 is assembled to a joiner support 24 in much the same manner as two joiner supports 24 are assembled.

Figure 21:
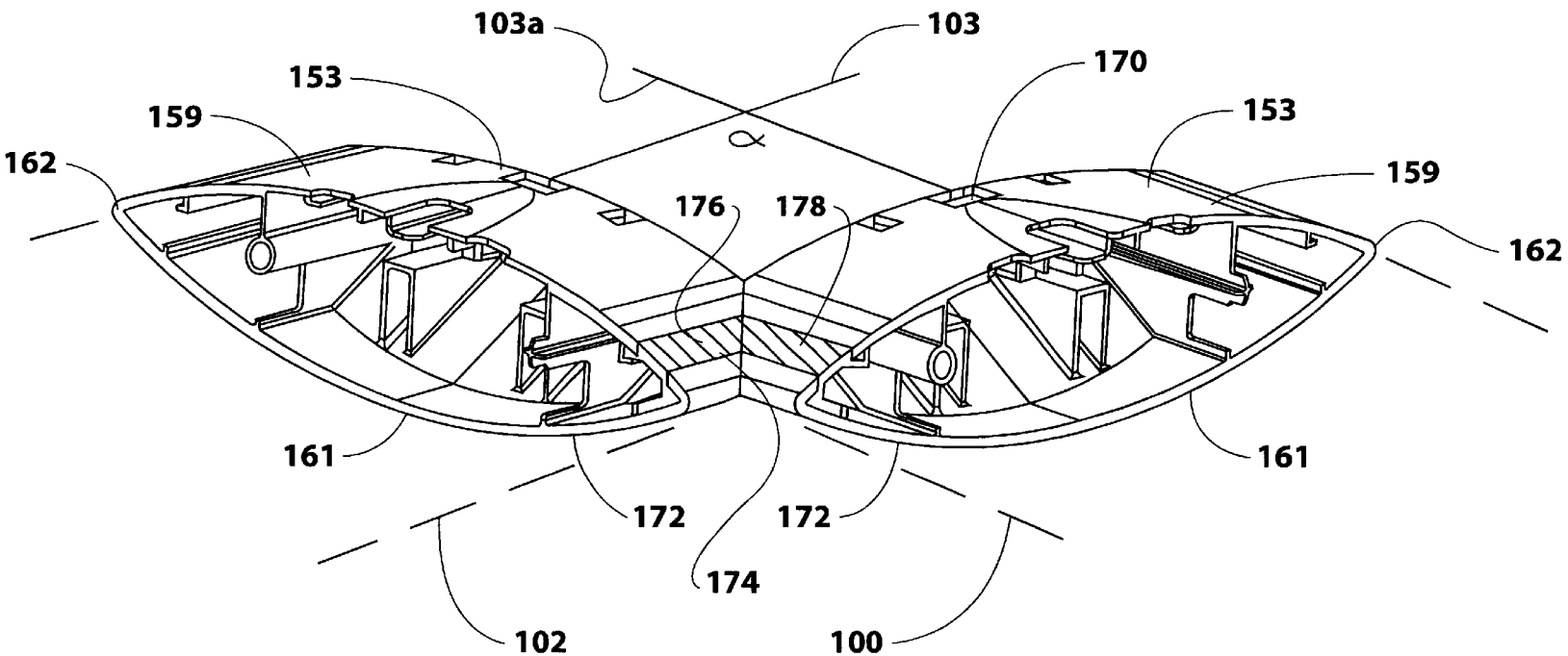
FIG. 21 is a perspective view showing the manner in which end caps are joined for a linear lighting fixture layout.
Figure 22:
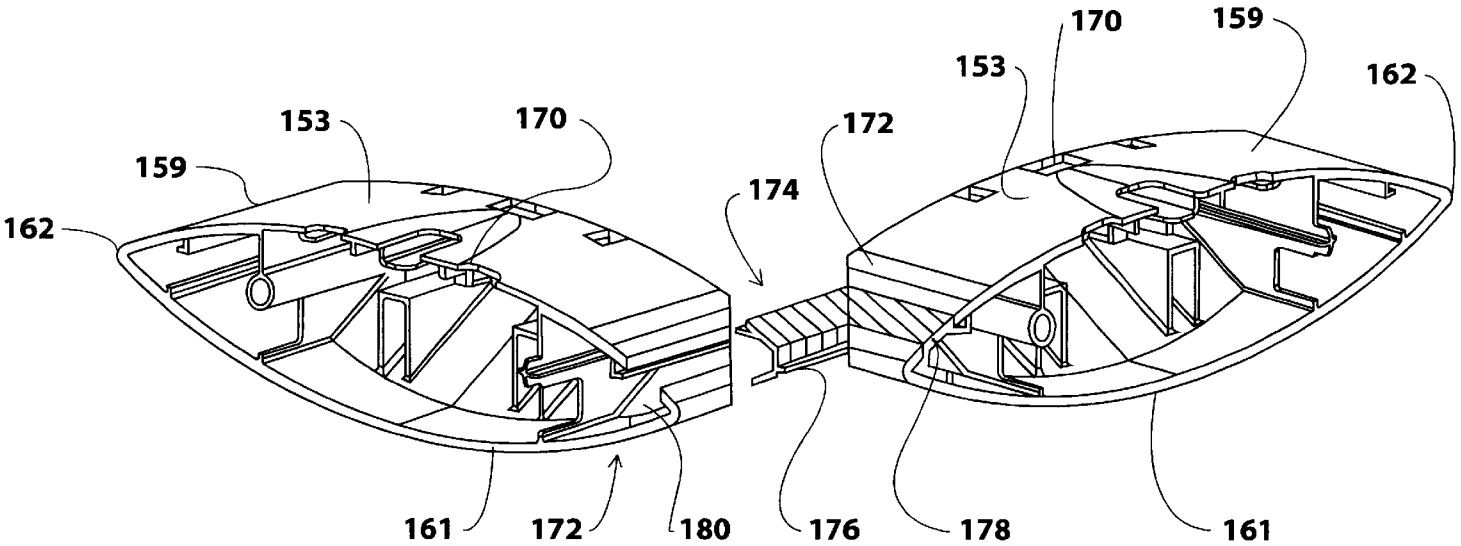
FIG. 22 is a partially exploded view of FIG. 21.
Figure 23:
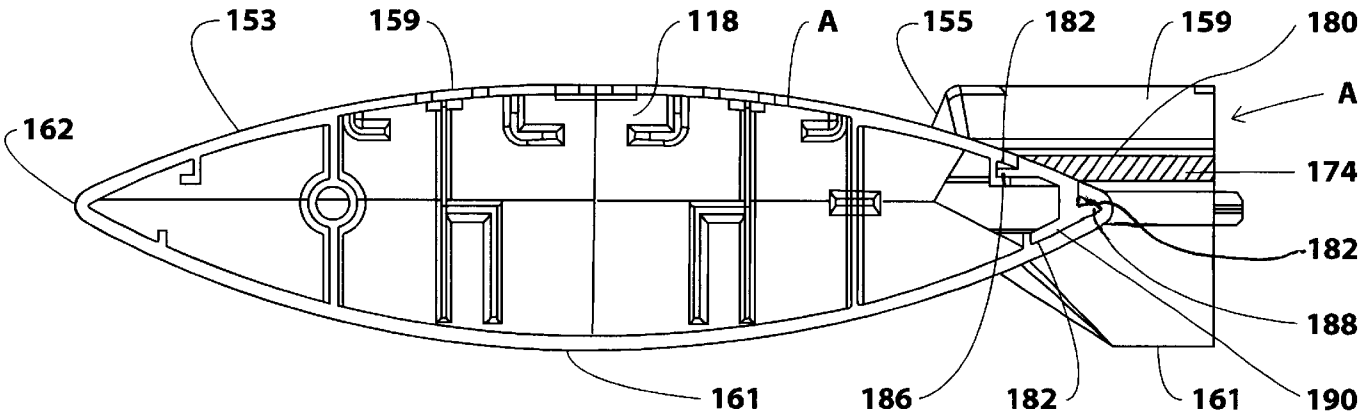
FIG. 23 is a side elevational perspective of FIG. 21.

Referring to FIGS. 21 through 23, there is shown a method of joining end caps 153 in a non-linear fashion. That is to say, the end caps 153 are joined to fixtures in the same manner as shown in FIGS. 17 to 20. These end caps 153, however, are for linear lighting fixtures that do not extend along the same longitudinal axis previously referred to as 103.

For the sake of simplicity, the end caps shown in FIGS. 21 and 22 do not show the insert required completing the first alignment slot in 118.

The end caps shown in FIGS. 21 through 23 are shown as able to be joined together at an angle of 90°. Each of the end caps 153 has a side 172 connected to an interconnecting member 174. Interconnecting member 174 has spaced or spread apart legs 176 and 178 that are adapted to be mounted to the sides or respective sides 172 of the two end caps 153.

The linear lighting fixtures are shown by ghost lines 100 and 102 to have respective longitudinal axes 103 and 103*a*. These axes are offset by the predetermined angle alpha ($\alpha$), which is 90°. The linear lighting fixtures 100 and 102 comprise the same construction as hereinbefore described.

Each of the sides 172 of the end caps 153 has an open or truncated side which has a slot 180. Each of the end caps 153 has inner surface walls 182 extending adjacent the slot opening 180. The legs 176 and 178 of the interconnecting member 174 have two elongated flanges 186 and 188 that are co-extensive with and are spaced from the opposing sides of each of the respective legs 176 and 178. These flanges 186 and 188 slide along the inner surface walls 182 to maintain the surfaces of the leg members 176 and 178 locked in place. The surfaces of the legs 176 and 178 provide a continuous surface along the side 172 of the end cap 170. In the cross-section shown in FIG. 23, the leg member 176 has a generally U-shaped configuration represented by the continuing surfaces of the flanges 186, 188 and an arm 190 positioned adjacent to the flanges 186, 188. The leg member 176 is adapted to slidingly engage the inner surface walls 182 of the end cap 170. Further the flange 188 of the leg 176 is located along the inside surfaces between the top and bottom walls of the end cap 153 adjacent or tucked in position at the corner where the top and bottom walls meet.

The interconnecting member 174 co-operating with the slot 180 in the sides 172 of the end cap 153 has the advantage of providing a quick connection between the end caps so that a continuous connection between the end caps are made and no visual space is seen between the linear lighting fixtures which extends along different predetermined axes. Hence the end portions 26 of the linear lighting fixtures 100 and 102 do not abut one another, however, the end caps 153 abut at adjacent sides 172 where the interconnecting member 174 is located. The angle of spread between the legs 176 and 178 of the interconnecting member 174 is equivalent to the angle $\alpha$ between the axes 103 and 103*a*.

It should be understood that the foregoing description with respect to the drawings has been for preferred embodiments of the present invention and that alternate embodiments may be readily apparent to a person skilled in the art.

What is claimed is:

1. A linear fixture layout comprising:

first and second linear fixtures each extending along respective first and second axes which are offset from each other by a predetermined angle, each of the first and second linear fixtures having respective first and second end portions positioned adjacent from each other;

an interconnecting member having first and second legs spread apart from each other at the predetermined angle, a first end cap adapted to be mounted to the first end portion of the first linear fixture, the first end cap having a first side, the first side having a first slot for receiving in sliding relation the first leg of the interconnecting member, and a second end cap adapted to be mounted to the second end portion of the second linear fixture, the second end cap having a second side, the second side having a second slot for receiving in sliding relation the second leg of the interconnecting member, the first leg being slidingly received by the first slot and the second leg being slidingly received by the second slot to fixedly locate the first end cap with the second end cap.

2. The linear fixture layout of claim 1 wherein the first and second end portions of the first and second linear fixtures are positioned spaced apart from each other, and the first second end caps abut each other.

3. The linear fixture layout of claim 1 wherein:

the first linear fixture comprises a first elongated housing having at least a first bottom wall and first joiner support mounted to the first bottom wall at the first end portion of the first linear fixture, the second linear fixture comprises a second elongated housing having at least a second bottom wall and second joiner support mounted to the second bottom wall at the second end portion of the second linear fixture, and the first and second end caps are mounted respectively to the first and second joiner supports.

4. The linear fixture layout of claim 3 further comprising a first hanger member adapted to respectively interconnect the first end cap with the first joiner support, wherein the first hanger member is adapted for suspension by a wire from an overhead structure for supporting the first linear fixture from the overhead structure.

5. The linear fixture layout of claim 4 further comprising a second hanger member adapted to respectively interconnect the second end cap with the second joiner support, wherein the second hanger member is adapted for suspension by a wire from an overhead structure for supporting the second linear fixture from the overhead structure.

6. The linear fixture layout of claim 1, wherein the first and second legs have first and second side surfaces respectively, said first and second side surfaces extending across the first and second slots respectively.

7. The linear fixture layout of claim 6 wherein:

the first and second end caps each have opposing inner surface walls extending adjacent with and on opposing sides of the respective first and second slots, and wherein the first and second legs each include two elongated flanges extending co-extensive with, spaced from, and on opposing sides of each of the first and second side surfaces of the first and second legs, the two flanges sliding along the inner surface walls to maintain the respective first and second side surfaces across the respective first and second receiving slots.

8. The linear fixture layout of claim 7 wherein the first and second end caps each have top and bottom walls having a cross-sectional in the shape of an eyelet with opposing sides of the end caps normally defined where the top wall and bottom wall meet.

9. The linear fixture layout of claim 8 wherein the first slot is in the top wall of the first end cap for receiving in sliding relation the first leg of the interconnecting member and wherein the second slot is in the top wall of the second end cap for receiving in sliding relation the second leg of the interconnecting member.

10. The linear fixture layout of claim 8 wherein the first and second legs have respectively the first and second side surfaces that bridge the first and second slots respectively presenting a continuous surface in the top wall of each of the first and second end caps.

11. The linear fixture of claim 7 wherein each of the first and second legs has two arms in a generally U-shape with one arm extending along the slot and the other arm extending along an bottom wall inside surface.

12. The linear fixture layout of claim 8 further having an opening in the top wall of each of the first and second end caps, said opening for receiving a wiring harness.

* * * * *